US005331748A

United States Patent [19]

Miller, Jr.

[11] Patent Number: 5,331,748

[45] Date of Patent: Jul. 26, 1994

[54] AIR FILTER FOR PORTABLE HAIR BLOW DRYER

[76] Inventor: Kenneth C. Miller, Jr., 4136 Galbar St., Oceanside, Calif. 92056

[21] Appl. No.: 910,518

[22] Filed: Oct. 26, 1992

[51] Int. Cl.[5] ..... F24H 3/04

[52] U.S. Cl. ..... 34/97; 392/385

[58] Field of Search ..... 392/380, 381, 382, 383, 392/384, 385; 34/97, 98, 3

[56] References Cited

U.S. PATENT DOCUMENTS 4,636,613 1/1987 de la Morandiere et al. ..... 34/97 X

*Primary Examiner*—Henry A. Bennett

[57] ABSTRACT

An air filter secured to the air inlet grid of a hand held hair blow dryer to prohibit the entry of airborne debris. The filter composed of a disc approximately one eighth this is removably fastened to the air inlet grid by means of transverse strips of double coated polyester film applied to the fastening surface of the filter disc. The exposed surface of the transverse strips are coated with a permanent rubber based adhesive which in turn is covered by a release liner to protect the adhesive surface during shipping and handling. The filter is fastened to the air inlet grid of the hand held blow dryer by removing the release liner and pressing the filter to the grid surface.

1 Claim, 1 Drawing Sheet

AIR FILTER FOR PORTABLE HAIR BLOW DRYER

BACKGROUND OF THE INVENTION

1. Field of the Invention

Hand held hair blow dryers with an air intake grid in the case have a tendency to accumulate airborne debris in the intake grid. An object of the instant invention is to removably attach an air filter over the intake screen to filter out such debris.

2. Description of the Related Art

U.S. Pat. No. 4,889,542 issued in 1989, titled Computer Air Filter Device, describes a filter panel to be adhesively attached to the outside of a computer and disc drive housing to cover the air intake grids used to draw air into the housing by a draft by a cooling fan in the housing.

SUMMARY OF THE INVENTION

The object of the instant invention is to provide an attachable, removable, filter over the outside surface of the air intake grids of a hand held hair blow dryer. The filter, in the form of a porous polyurethane disc approximately one eighth inch thick, is adhesively attached to the air intake grid by three spaced strips of double coated polyester strips adhesively coated on the inside surface with a permanent rubber based adhesive and on the outside exposed surface with a removable acrylic adhesive. Said exposed surface is protected by an adhesive polyester release liner which is removed when the filter is attached to the hair blower air intake grid.

DETAILED DESCRIPTION OF THE PREFERRED EMBODIMENTS

Figure 1:
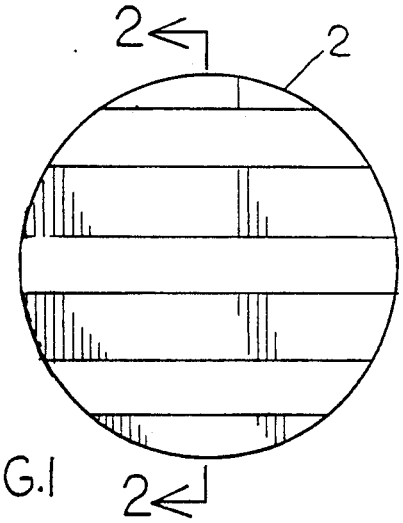
FIG. 1 is a bottom view of the air filter disc.
Figures 2, 3:
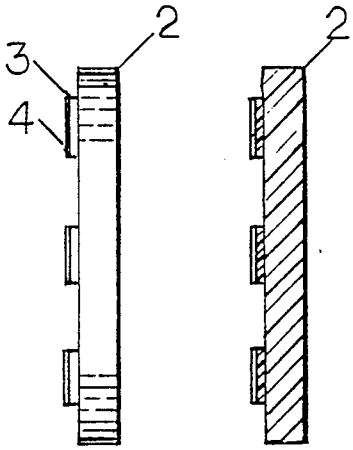
FIG. 2 is a sectional view through 2—2 of FIG. 1.
FIG. 3 is a right side elevation of the air filter disc the opposite side being a mirror image thereof.
Figure 4:
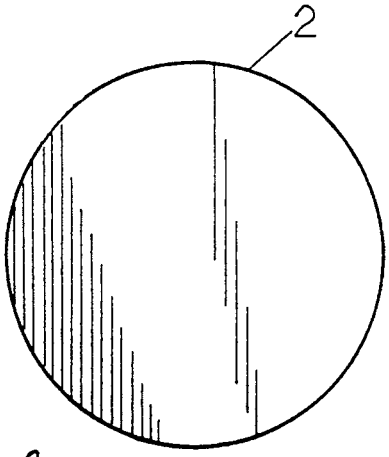
FIG. 4 is a top plan view of the air filter.
Figure 5:
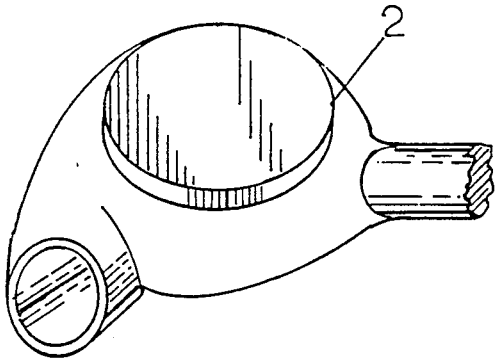
FIG. 5 is a perspective view of the air filter attached to the hair blow dryer.

Referring to FIGS. 1 and 3, the air filter disc 2 is shown with three transverse strips 3 of double coated polyester film approximately three sixteenths of an inch wide adhesively attached to the bottom surface. The exposed surface of said adhesive strips covered with a removable film of adhesive polyester release liner 4 which is removed when the filter is attached to the air intake grid of the blow dryer. The air filter disc 2 is made of three inch diameter, approximately one eighth inch thick, porous polyurethane foam material, or the like.

I claim:

1. A hand held motor drive hair dryer having an air inlet grid wherein the improvement comprises:

(a), a disc of porous polyurethane foam approximately one eighth of inch thick air filter material placed over the air inlet grid;

(b), the disc removably affixed to the filter disc by transverse strips of double coated polyester film;

(c), said transverse strips protected during shipment and handling by a removable film of polyester adhesive release liner on the exposed surface of said strips; and, (d), by removing releaser liner from the transverse strips of air filter is temporarily secured to the surface of the air inlet grid.

* * * * *